United States Patent [19]

Goloff

[11] 3,958,907

[45] May 25, 1976

[54] ISOTHERMAL APEX SEAL FOR ROTARY ENGINES

[75] Inventor: Alexander Goloff, East Peoria, Ill.

[73] Assignee: Caterpillar Tractor Co., Peoria, Ill.

[22] Filed: Jan. 20, 1975

[21] Appl. No.: 542,533

[52] U.S. Cl. ..... 418/91; 418/113; 277/26

[51] Int. Cl.[2] ..... F01C 19/02; F01C 21/06; F16J 15/00

[58] Field of Search ..... 418/83, 91, 112–124, 418/152; 277/26

[56] References Cited

UNITED STATES PATENTS

| | | | |
|---|---|---|---|
| 1,763,574 | 6/1930 | Williams | 277/26 |
| 3,007,600 | 11/1961 | Horner | 277/26 |
| 3,113,526 | 12/1963 | Paschke | 418/122 |
| 3,180,564 | 4/1965 | Fuhrmann et al. | 418/122 |

FOREIGN PATENTS OR APPLICATIONS

| | | | |
|---|---|---|---|
| 1,189,783 | 3/1965 | Germany | 418/91 |
| 576,206 | 3/1946 | United Kingdom | 277/26 |
| 1,254,901 | 11/1967 | Germany | 418/83 |

*Primary Examiner*—John J. Vrablik
*Attorney, Agent, or Firm*—Wegner, Stellman, McCord, Wiles & Wood

[57] ABSTRACT

An improved sealing structure for rotary engines of the type having a housing with a rotor therein, the latter having at least two apices. The rotor includes a plurality of grooves corresponding to the number of apices and each groove is located at a respective one of the apices. A plurality of apex seals is provided with one disposed in each of the grooves so as to extend partially out of the groove to engage the housing. Each seal includes an internal closed cavity and the cavity, in turn, is only partially filled with a body of vaporizable material. The material has the characteristic of undergoing a phase change to the vapor phase when subjected to the relatively high temperatures present within the housing due to combustion gasses and frictional contact with the housing and from the vapor phase when subjected to the relatively lower temperature of the rotor. The material circulates within the seal while undergoing phase changes to continuously cool the seals to preclude distortion of the same.

5 Claims, 3 Drawing Figures

ISOTHERMAL APEX SEAL FOR ROTARY ENGINES

BACKGROUND OF THE INVENTION

This invention relates to rotary engines and, more particularly, to seals employed in rotary engines.

The most pertinent prior art known to the applicant includes U.S. Pat. No. 3,180,564.

While the operating principles of various types of rotary engines, such as the so-called "Wankel" engine have long been known, it has only been within the last few years that such engines have been made commercially available. Even with the commercial availability of such engines from certain manufacturers, other manufacturers apparently remain unsatisfied that various problems with the operation of such engines have been completely overcome so as to allow their being offered commercially.

Perhaps one of the more vexing problems in rotary engines is the maintenance of seals between the rotor and the housing walls. There are two general areas of difficulty in the seals employed. A first is that of providing a long-lived seal that will not require frequent replacement to the point where use of the engine is commercially unfeasible. A second is the provision of a seal that will effectively provide a seal during operaton of the engine throughout a wide range of internal temperature conditions.

While various proposals for seal constructions have been made to overcome such difficulties, the problems still have not been solved to the satisfaction of even the majority of engine builders.

SUMMARY OF THE INVENTION

It is the principal object of the invention to provide a new and improved rotary engine. More specifically, it is an object of the invention to provide a rotary engine including improved seals that are long-lived and will not distort under a wide range of operating conditions.

An exemplary embodiment of the invention achieves the foregoing objects in a structure including a housing having an interior wall and a rotor within the housing. The rotor is provided with at least one seal receiving groove and an elongated seal is disposed in such groove so as to partially extend out of the groove to sealingly engage the housing wall. The seal has an internal closed cavity and the cavity is only partially filled with a body of vaporizable material. The material partially filling the cavity is selected to have the characteristic of undergoing a phase change to the vapor phase when subjected to relatively high temperatures due to heat generated by frictional contact of the seal with the housing wall and combustion gasses. It also has the characteristic of undergoing a phase change from the vapor phase when subjected to the relatively lower temperature of the rotor.

As a consequence, the body of material, when in that portion of the cavity adjacent the portion of the seal extending out of the groove, will be vaporized to cool the corresponding portion of the seal. Vapor will then move into that portion of the seal within the rotor groove to be cooled and condensed. The cycle continually repeats itself such that the seal is maintained at a relatively low temperature. Because of such temperature maintenance, the increased frictional wear associated with high temperature operation is eliminated while distortion of the seal associated with high temperature operation resulting in ineffective sealing is avoided.

In a highly preferred embodiment of the invention, the seals are employed as apex seals, being located in grooves at apices on the rotor. That portion of the seal within the groove is fluted so that the seal is flexible so as to more easily conform to the surface of the housing wall during operation. The flexibility automatically compensates for housing distortion when and if such occurs.

In a highly preferred embodiment of the invention, the rotary engine is of the so-called "Wankel" or slant axis rotary variety and the housing and the rotor are configured to provide compression ratios in the diesel range.

Other objects and advantages will become apparent from the following specification taken in conjunction with the accompanying drawings.

DESCRIPTION OF THE PREFERRED EMBODIMENT

Figure 1:
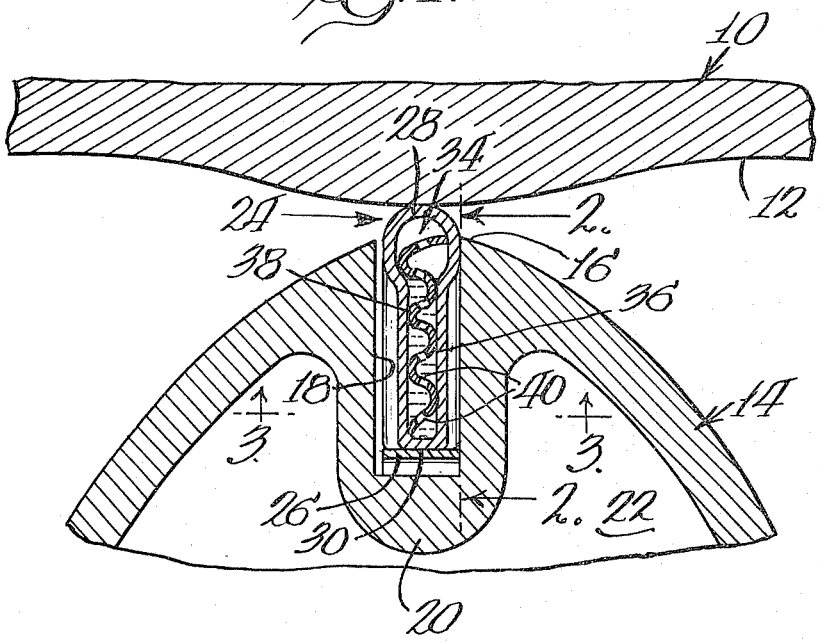
FIG. 1 is a fragmentary, somewhat schematic, sectional view of a rotary engine embodying the invention.

An exemplary embodiment of a rotary engine made according to the invention is illustrated in the drawings with the components configured in a well-known manner of a so-called Wankel engine. Preferably, the rotor and housing are structured so that during operation, compression ratios in the diesel range, i.e., 16:1, or better, are developed.

With the understanding that FIG. 1 illustrates the components in an "at rest" configuration, the invention will be described in detail. The engine includes a housing shown fragmentally and generally designated 10, having an interior wall 12 defining a chamber in which a rotor, generally designated 14, moves in a conventional fashion. The rotor 14 includes at least two apices 16 (only one of which is shown) and when configured as a Wankel engine, three apices 16 will be provided.

At each apex 16, a seal receiving groove 18 is provided. In the embodiment illustrated in FIG. 1, the grooves 18 are formed in bosses 20 in the rotor which project into an interior chamber 22 for receiving a coolant in a well known manner. Disposed in each groove 18 is an apex seal, generally designated 24, which is biased against the housing wall 12 by means of any conventional means such as an undulating leaf spring 26 in the bottom of the groove 18.

Figure 2:
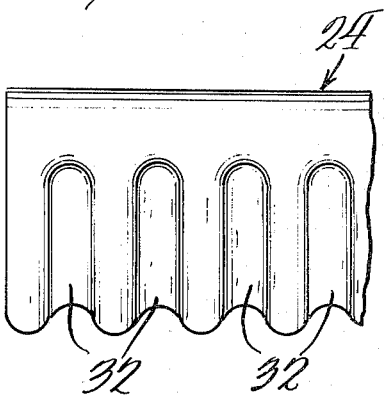
FIG. 2 is a sectional view taken approximately along the line 2—2 in FIG. 1.
Figure 3:
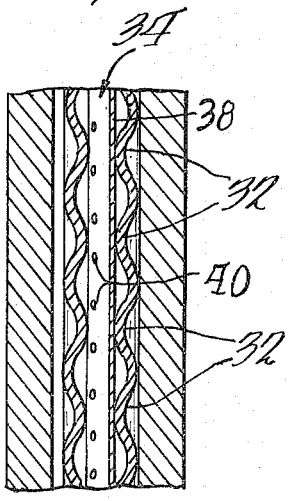
FIG. 3 is a sectional view taken approximately along the line 3—3 in FIG. 1.

Each seal 24 includes an end 28 for engaging the housing wall 12 and an opposite end 30 in engagement with the biasing means 26. As seen in FIGS. 2 and 3, that portion of the seal within the groove and extending to the end 30 is fluted as at 32 to provide the seal 24 with flexibility.

The seal 24 includes a closed interior cavity 34 that extends approximately from one end 28 of the seal 24 to the other end 30. The cavity 34, in turn, is only partially filled with a body 36 of vaporizable material which normally will be in liquid form. It is to be emphasized that the body of material 36 only partially fills the cavity 34 and, in a preferred embodiment, will at least half fill the cavity 34.

The invention is not limited to any particular type of vaporizable material 36, but the material must have one essential characteristic. The same must change phase from a liquid or solid state to the vapor phase when in contact with the end 28 of the seal 24. At the end 28, the body of material 36 will essentially be exposed to relatively high temperatures generated by (*a*) frictional contact of the seal 24 with the wall 12 during operation and (*b*) the heat of combustion gasses within the housing 10. The material 34 must have the further characteristic that it will change from a vapor phase to a liquid or solid phase when in contact with that portion of the seal disposed within the groove 18, such as the end 30, which will essentially be at a relatively low temperature corresponding approximately to that of the rotor 14. In this connection, the temperature of the rotor 14 may be appropriately regulated by introducing any appropriate coolant into the cavity 22.

Preferably, the material 36 will be flowable at normal operating temperatures of the rotor 14, i.e., will be in the liquid phase. A further desirable characteristic is that the material 36 be able to withstand the high operating temperatures customarily found in the engine without deterioraton. Still a further desirable characteristic of the material 36 is that it be such that the pressure generated by its vaporization within the cavity 34 adjust automatically to the prevailing temperatures. In other words, the higher the operating temperature, the higher the pressure generated by the material 36 within the cavity. In a highly preferred embodiment of the invention, the material 36 is water and the amount thereof placed in the cavity 34 is sufficient to fill the latter to the extent of about 40–60% of its volume.

Optionally, the seal 24 may be provided with an internal, corrugated stiffening member 38 extending along the length of the seal 24. The stiffening member 38 includes a plurality of perforations 40 to permit relatively free flow of the material 36 within the cavity 34.

The body of material 36 acts to provide cooling action for the seal 24 in the following manner. When the engine is in operation and the rotor 14 is turning within the housing 10, centrifugal force will cause that portion of the body of material 36 not in a vapor form to move radially outwardly of the rotor to the end 28 of the seal 24. At this end, a certain portion of the material 36 will be vaporized. Because of the lesser density of the vapor, unvaporized material 36 will displace the vapor at the end 28 causing the vapor to move toward the end 30 at which point it will be cooled and undergo a phase change from the vapor phase, normally to the liquid phase.

The vaporization of the body of material 36 at the end 28 will cause that end of the seal 28 to be cooled while the heat given up upon condensation of the material 36 at the end 30 will be dissipated in the rotor 14, normally to coolant in the cooling chamber 22.

The foregoing action will continuously cyclically occur to cool the seal 24. As a result of such cooling, the high rate of frictional wear attendant high temperature operation will be precluded by reason of the lower operating temperature of the seal 24 at its point of contact with the housing wall 12. And, at the same time, with the seal 24 operating at a lower temperature, distortions therein due to temperature differentials across the same will be minimized so that excellent sealing contact of the end 28 with the wall 12 will be provided for all operating conditions. As a result, an improved seal is provided increasing engine operating efficiency.

Moreover, the use of a material such as water for the material 36 with the characteristic of automatic pressure compensation permits the use of a relatively thin walled seal 28 so as to maximize heat transfer. By reason of the fact that higher operating temperatures will result in greater internal pressures within the seal cavity 34, the walls of the seal tend to be more resistant to collapse under pressure at high temperatures due to the increased internal pressures associated therewith. To the extent that wall reinforcement is required, the thin walled nature can be maintained through the use of internal stiffeners such as the stiffener 38. In this respect, the fluting also serves to stiffen the walls of the seal 28 to permit minimum wall thickness.

Finally, provision of the fluting in the seal provides sufficient flexibility so that the same may readily conform to the wall 12 during operation.

What is claimed is:

1. In a rotary engine, the combination comprising:

a housing;

a rotor having at least two apices and within said housing;

a plurality of grooves in said rotor corresponding to the number of apices and each located at a respective one of said apices;

a plurality of apex seals, one disposed in each of said grooves and extending partially out of the corresponding groove to engage said housing, each of said seals having an internal, closed cavity; and a body of vaporizable material within and only partially filling the cavity of each of said seals, said material having the characteristic of undergoing phase changes to the vapor phase when subjected to relatively high temperatures due to heat generated by friction and combustion gasses and from the vapor phase when subjected to the relatively lower temperature of said rotor.

2. The rotary engine of claim 1 wherein said rotor includes a coolant chamber for receiving a coolant adjacent each of said grooves.

3. A rotary engine according to claim 1 wherein the portion of each of said seals disposed within the corresponding groove is fluted to allow for flexing of the corresponding seal and distortion of said housing.

4. In a rotary engine, the combination comprising: a housing having an interior wall; a rotor within said housing; at least one groove in said rotor adjacent said wall; a seal disposed in said groove and extending partially out of said groove to sealingly engage said housing wall, said seal having an internal closed cavity; a body of vaporizable material within and only partially filling the cavity of said seal, said material having the characteristic of undergoing phase changes to the vapor phase when subjected to relatively high temperatures due to heat generated by frictional contact with said housing wall and the heat of combustion gasses within said housing, and from the vapor phase when subjected to the relatively lower temperature of said rotor; means urging said seal out of said groove into contact with said housing wall; and a coolant receiving space in said rotor in proximity to said groove to cool the portion of said seal within said groove.

5. A rotary engine according to claim 4 wherein a corrugated, perforated stiffening member is disposed within said internal closed cavity and extends along the length of said seal.

* * * * *